United States Patent [19]

Berber et al.

[11] 4,262,841

[45] Apr. 21, 1981

[54] TRUNCATED CONICAL DISC SEPARATOR

[76] Inventors: Viktor A. Berber, ulitsa Shelkovichnaya, 184, kv. 65; Gennady G. Korobov, prospekt Kirova, 14/16, kv. 45, both of Saratov, U.S.S.R.

[21] Appl. No.: 952,729

[22] Filed: Oct. 19, 1978

[30] Foreign Application Priority Data

Oct. 26, 1977 [SU] U.S.S.R. ..... 2538106

[51] Int. Cl.[3] ..... B04B 1/08

[52] U.S. Cl. ..... 233/29

[58] Field of Search ..... 233/27, 28, 29, 35, 233/39, 41

[56] References Cited

U.S. PATENT DOCUMENTS

| | | | |
|---|---|---|---|
| 1,038,607 | 9/1912 | Lawson | 233/29 |
| 1,602,752 | 10/1926 | Cuthbert | 233/29 |
| 1,634,759 | 7/1927 | Sharples | 233/29 |
| 3,409,521 | 11/1968 | Sharples | 233/29 X |

FOREIGN PATENT DOCUMENTS

| | | | |
|---|---|---|---|
| 405408 | 11/1909 | France | 233/29 |
| 23161 | 5/1905 | Sweden | 233/29 |

*Primary Examiner*—George H. Krizmanich

*Attorney, Agent, or Firm*—Lackenbach, Lilling & Siegel

[57] ABSTRACT

According to the invention a truncated conical disc is provided with inward and outward flanges carrying projections and a plurality of curved bars or ribs located so that the projection thereof onto a plane perpendicular to the axis of spinning is a plurality of converging spirals. The height of each rib at a section through the normal to the truncated conical surface of the disc and the plate is between 0.2 and 0.5 the height of the projections. As reviewed in section, the edge of each rib, meets head-on the flow of the liquid clarified, and makes an angle approximately 90 deg. with the truncated conical surface of the disc.

3 Claims, 5 Drawing Figures

TRUNCATED CONICAL DISC SEPARATOR

BACKGROUND OF THE INVENTION

FIELD OF THE INVENTION

The present invention relates to equipment for the removal of solids from liquid phase depending on its size and more specifically, to a truncated conical disc separator.

The invention may be used for the separation of fine sediments from lube oil, fuel and cutting fluids in the aircraft, machine tool, chemical, dairy and other industries.

DESCRIPTION OF THE PRIOR ART

There is known a conical disc separator (cf. USSR Inventor's Certificate No. 157,168; Cl.B04B 7/00,1962) which is provided with inward and outwards flanges carrying projections and with a means of separating solids. The means of separating solids is provided in the form of a circular threshold located at the outlet wherethrough the clarified liquid is discharged. A disc of such construction is capable of holding back the particles which have settled to the surface thereof and reduces the number of particles carried away with the flow of clarified liquid. Yet, in filtering fine particles when the adjacent conical discs are set just 0.4 to 1.5 mm apart and the flow of the liquid clarified moves from the periphery of each disc to the centre thereof, difficulties are experienced with the discharge of those particles which have accumulated at the threshold. The explanation is that the circular threshold runs in a locality next to the outlet where the radius of the disc is at its minimum and the consequent centrifugal forces are by far smaller than at the disc periphery. Also vortexes which are likely to occur can carry the particles settled at the circular threshold into the clean space along with the flow of clarified liquid, and the (dirt) holding capacity of each pocket formed by the circular threshold and inward flange is too small.

SUMMARY OF THE INVENTION

It is an object of the present invention to provide a truncated conical disc separator wherein the means of separating solids are constructed so as to enhance the reliability of solids separation and reduce the amount of solids carried away with the flow of clarified liquid.

Another object of the present invention is to improve the selfcleaning properties of the truncated conical disc.

The essence of the invention resides in a truncated conical disc separator, provided with inward and outward flanges carrying projections and a plurality of curved ribs located so that said bars, when viewed as a projection thereof onto a plane perpendicular to the axis of spinning make up a plurality of converging spirals. The angle alpha measured between the tangent to any point in the plane of each rib from the side of the direction of the flow of the liquid being clarified and the vector of the velocity of the flow of the liquid being clarified at the same point—which vector directionally coincides with the movement of the solids being disposed of. The angle alpha at any point is greater than the friction angle of the solids as they slide along the conical surface of the disc and is between 30 and 60 deg., while the height of each rib in a section passing through the normal to the conical surface of the disc and the bar is between 0.2 and 0.5 the height of the projections, and in a normal section the edge of each rib meeting head-on the flow of the liquid clarified makes an angle close to 90 deg. with the conical surface of the disc.

The present invention enhances the reliability of solids separation, reducing the amount of solids carried away with the flow of the liquid clarified and improving the self-cleaning properties of the truncated conical disc.

It is expedient to arrange the plurality of bars or ribs on the inner conical surface of the disc when filtering liquids containing solids of a density higher than the density of the liquid clarified because said solids displace relative to the flow of the liquid clarified from the axis of spinning to the periphery.

It is also expedient, when clarifying liquid containing solids the density whereof is lower than the density of the liquid, to arrange the plurality of ribs on the outward conical surface of the disc. Such solids, displacing relative to the flow of the liquid clarified, move towards the centre when the separator is in operation.

A preferred embodiment of the present invention will now be described by way of an example with reference to the accompanying drawings in which.

DETAILED DESCRIPTION OF THE INVENTION

Figure 1:
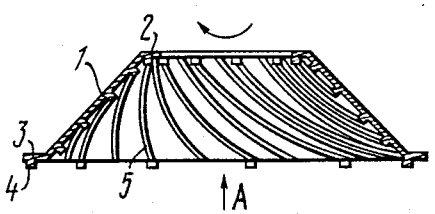
FIG. 1 is a sectional elevation of a truncated conical disc or plate separator according to the invention, used to separate heavy-weight solids.

The truncated conical disc separator of the present invention consists of a conical portion I (FIGS. 1 and 4), an inward flange 2 along with an outward flange 3, both carrying projections 4 (FIGS. 2 and 4), and a means for separating and retaining solids. The means for retaining solids comprises a plurality of ribs 5 located so that the projection thereof on a plane perpendicular to the axis of spinning makes up a plurality of converging spirals, somewhat like a 24 start Archimedes' Spiral. An angle (Alpha) $\alpha$, measured between the tangent to any point in the plane of each rib which from the side of the direction of the flow of the liquid being clarified and the vector of the velocity of the flow of the liquid being clarified at the same point which vector directionally coincides with the movement of the solids being disposed of. The said angle alpha is greater than the angle of friction of the solids as such slide solids along the conical surface of the disc. The angle $\alpha$ (alpha) may vary over the range between 30 and 60 deg. depending on the viscosity of the liquid and the physical as well as chemical properties of the solids.

Figure 3:
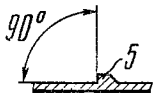
FIG. 3 is a section on line III—III of FIGS. 2 and 5.

The height of each rib 5 at a section through the normal to the truncated conical surface of the disc and the rib 5 is 0.2 to 0.5 the height of a projection 4, and in a normal section the edge of a rib 5 meeting head-on the flow of the liquid clarified makes an angle close to 90 deg. with the surface of the disc (FIG. 3).

Figure 2:
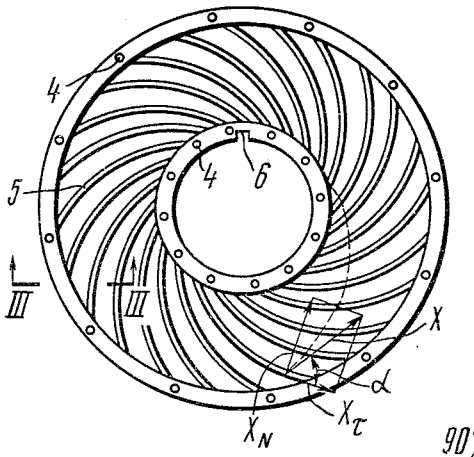
FIG. 2 is a bottom plan view of the conical disc looking in the direction of arrow A in FIG. 1.
Figure 5:
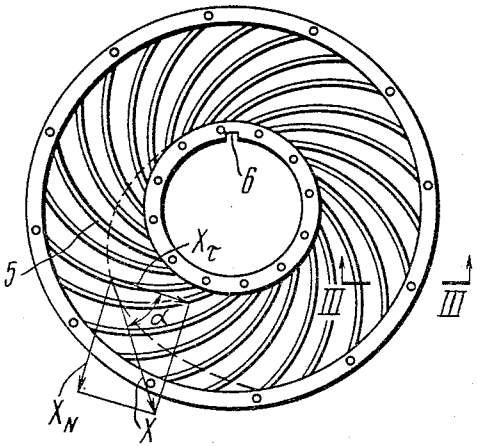
FIG. 5 is a top plan view of the conical disc shown in FIG. 4.

The truncated conical discs are assembled into a stack with the aid of a key way 6 (FIGS. 2 and 5).

When the rotor is set spinning integrally with the stack of truncated conical discs, suspension enters the spaces between the discs by way of slots formed due to the presence of the outward flanges 3 (FIG. 1) or inward flanges 2 (FIG. 4) of two adjacent discs and the separation of solids goes on in said spaces. When each of the discs is provided with ribs along the generatrix thereof of a height equal to the height of the space between two adjacent discs, it is known that the flow of the liquid clarified moves parallel to the generatrix of the cone. If no guiding ribs are available, as considered herein for explanation, an angular velocity component set up in the flow of the liquid clarified due to the Coriolis force causes the flow to move along a helical shape (shown in a dotted line in FIGS. 2 and 5) over the conical passage.

As the suspension moves along the truncated conical portion I of the disc from the periphery thereof towards the centre, the solids of a density which are higher than the density of the liquid displace to the inward side of the conical disc (FIGS. 1 and 2). As a particle which has settled and is being dragged by the flow of the liquid clarified continues its travel along the inward conical surface of the disc, it meets one of the ribs 5. Since the shape of said rib which is helical, or part of a helix, is determined by the condition that the angle $\alpha$, which angle is measured between the tangent to any point in the plane of each rib from the side of the direction of the flow of the liquid being clarified and the vector of the velocity of the flow of the liquid clarified said vector, (which vector directionally coincides with the movement of the solids being disposed of). Angle alpha is greater than the friction angle of the solids as they slide along the conical surface of the disc and is between 30 and 60 deg. The force X set up by the flow is resolved into a normal component $X_N$ pressing the particle to the forward edge of the rib 5 and a tangential component $X_T$ enabling the particles to discharge in a direction opposite to that of the passages for the clarified liquid. This improves the self-cleaning properties of the truncated conical disc and minimizes the possibility of carrying the settled particles away with the clarified liquid.

A multiple crossing of the ribs 5 by the flow of the liquid clarified away from the zones of vortexes provides for a more reliable holding back of the settled particles than ever before.

Figure 4:
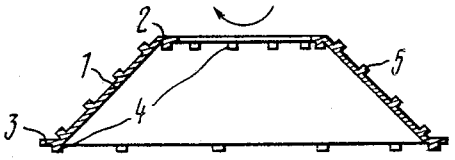
FIG. 4 is a sectional elevation of a conical disc for the separator according to the invention used to separate light-weight solids.

In all those cases when the liquid subject to separation includes particles the density whereof is less than the density of the liquid, the set of ribs 5 are attached, in accordance with the above, on the outward side of the truncated conical portion I of the disc (FIGS. 4, 5).

What is claimed is:

1. A separator for separating solid particles from liquids comprising a truncated conical disc having an inwardly extending flange at one end of said disc, and outwardly entending flange at the other end of said disc, a plurality of spaced projections on said outward and inward flanges, a plurality of curved ribs located on the surface of said disc shaped such that when viewed as a projection thereof on a plane perpendicular to the longitudinal axis of said disc produces a plurality of helical curves, each said curve having a pitch such that an angle alpha at any point along said rib that is greater than the angle of friction of the solids as such solids slide along the truncated surface of the disc, said angle alpha being measured between the tangent to any point in the plane of each said rib from the side of the direction of the flow of the liquid being clarified and the vector of the velocity of the flow of the liquid being clarified, said vector directionally coinciding with the movement of the solids being disposed of, said angle alpha being between 30 and 60 deg., the height of said ribs measured in a section normal to the truncated conical surface of the disc and said rib being between 0.2 and 0.5 the height of said projections, and said rib having an upstanding edge which meets head-on the flow of said liquid being clarified and forms an angle approximately 90 deg. with the surface of said disc.

2. A separator for separating solids as claimed in claim 2, wherein said plurality of ribs are located on the inner surface of the disc.

3. A separator as in claim 2, wherein said plurality of ribs are located in the outer surface of the disc.

* * * * *